US007064648B2

(12) United States Patent
Tanaka

(10) Patent No.: US 7,064,648 B2
(45) Date of Patent: Jun. 20, 2006

(54) ALLOY TYPE THERMAL FUSE AND MATERIAL FOR A THERMAL FUSE ELEMENT

(75) Inventor: Yoshiaki Tanaka, Osaka (JP)

(73) Assignee: Uchihashi Estec Co., Ltd., Osaka (JP)

( * ) Notice: Subject to any disclaimer, the term of this patent is extended or adjusted under 35 U.S.C. 154(b) by 85 days.

(21) Appl. No.: 10/656,698

(22) Filed: Sep. 4, 2003

(65) Prior Publication Data

US 2004/0174243 A1 Sep. 9, 2004

(30) Foreign Application Priority Data

Mar. 4, 2003 (JP) ..... P2003-056760

(51) Int. Cl.
*H01H 85/06* (2006.01)
*H01H 85/11* (2006.01)

(52) U.S. Cl. ..... 337/290; 337/160; 337/181; 337/296

(58) Field of Classification Search ..... 337/152, 337/159, 160, 180, 181, 290, 158, 296; 29/623; 148/400; 420/561, 562, 559, 577
See application file for complete search history.

(56) References Cited

U.S. PATENT DOCUMENTS 1,214,879 A * 2/1917 Baruch ..... 337/184
3,236,976 A * 2/1966 Rayno ..... 337/292
5,752,310 A * 5/1998 Kondo et al. ..... 29/623
5,821,847 A * 10/1998 Totsuka ..... 337/166
6,064,293 A * 5/2000 Jungst et al. ..... 337/290
6,160,471 A * 12/2000 Rybka et al. ..... 337/278
6,222,438 B1 * 4/2001 Horibe et al. ..... 337/290
6,241,145 B1 6/2001 Maeda et al.
6,570,482 B1 * 5/2003 Brown et al. ..... 337/160
6,791,448 B1 * 9/2004 Kaltenborn et al. ..... 337/160

FOREIGN PATENT DOCUMENTS

EP 0 629 467 A1 12/1994
EP 0 711 629 A1 5/1996
JP 56-114237 A 9/1981
JP 59-8229 A 1/1984
JP 59-8231 A * 1/1984
JP 6325670 A 11/1994
JP 2000-141079 A 5/2000
JP 2001-266723 A 9/2001
JP 2001266724 A 9/2001
JP 2001325867 A 11/2001
JP 2002-025405 A 1/2002
JP 2002150906 A 5/2002

* cited by examiner

*Primary Examiner*—Anatoly Vortman
(74) *Attorney, Agent, or Firm*—Akin Gump Strauss Hauer & Feld, LLP

(57) ABSTRACT

An alloy type thermal fuse is provided in which a Bi—Sn alloy is used as a fuse element, which has an operating temperature of about 140° C., which, even when used at a high power, can safely operate, and in which dispersion of the operating temperature can be sufficiently reduced. Also a material for a thermal fuse element is provided.

An alloy composition in which Bi is larger than 50% and 56% or smaller, and a balance is Sn is used as a fuse element of the alloy type thermal fuse.

16 Claims, 9 Drawing Sheets

(A)

(B)

(A)

(B)

ALLOY TYPE THERMAL FUSE AND MATERIAL FOR A THERMAL FUSE ELEMENT

BACKGROUND OF THE INVENTION

1. Field of the Invention

The present invention relates to an alloy type thermal fuse in which a Bi—Sn alloy is used as a fuse element, and which has an operating temperature of about 140° C., and also to a material for a thermal fuse element.

An alloy type thermal fuse is widely used as a thermo-protector for an electrical appliance or a circuit element, for example, a semiconductor device, a capacitor, or a resistor.

Such an alloy type thermal fuse has a configuration in which an alloy of a predetermined melting point is used as a fuse element, the fuse element is bonded between a pair of lead conductors, a flux is applied to the fuse element, and the flux-applied fuse element is sealed by an insulator.

The alloy type thermal fuse has the following operation mechanism.

The alloy type thermal fuse is disposed so as to thermally contact an electrical appliance or a circuit element which is to be protected. When the electrical appliance or the circuit element is caused to generate heat by any abnormality, the fuse element alloy of the thermal fuse is melted by the generated heat, and the molten alloy is divided and spheroidized because of the wettability with respect to the lead conductors or electrodes under the coexistence with the activated flux that has already melted. The power supply is finally interrupted as a result of advancement of the spheroid division. The temperature of the appliance is lowered by the power supply interruption, and the divided molten alloys are solidified, whereby the non-return cut-off operation is completed.

Conventionally, a technique in which an alloy composition having a narrow solid-liquid coexisting region between the solidus and liquidus temperatures, and ideally a eutectic composition is used as such a fuse element is usually employed, so that the fuse element is fused off at approximately the liquidus temperature (in a eutectic composition, the solidus temperature is equal to the liquidus temperature). In a fuse element having an alloy composition in which a solid-liquid coexisting region exists, namely, there is the possibility that the fuse element is fused off at an uncertain temperature in the solid-liquid coexisting region. When an alloy composition has a wide solid-liquid coexisting region, the uncertain temperature width in which a fuse element is fused off in the solid-liquid coexisting region is correspondingly increased, and the operating temperature is largely dispersed. In order to reduce the dispersion, therefore, an alloy composition having a narrow solid-liquid coexisting region between the solidus and liquidus temperatures, or ideally a eutectic composition is used.

Because of increased awareness of environment conservation, the trend to prohibit the use of materials harmful to a living body is recently growing as a requirement on an alloy type thermal fuse. Also an element for such a thermal fuse is strongly requested not to contain a harmful element (Pb, Cd, Hg, Tl, etc.).

Conventionally, a Bi—Sn eutectic alloy (57% Bi, balance Sn) is known as an element for a thermal fuse which does not contain an element harmful to a living body, and which has an operating temperature of about 140° C.

2. Description of the Prior Art

Conventionally, functions of an electrical appliance are advanced, and the power consumption of an appliance is increased. Therefore, a thermal fuse is requested to have a high power rating of AC 250 V and 5 A or more.

When an alloy type thermal fuse is used at a voltage as high as AC 250 V, an arc is easily generated at an operation of the fuse. As a result, substances such as a charred flux produced by the arc, and molten portions of a fuse element are scattered to adhere to the inner wall of a case, thereby forming a resistor path, and a current may flow through the resistor path. The thermal fuse may be damaged or broken by Joule's heat due to the current. In succession to the current flow through the resistor path, or after interruption of the current flow, a rearc may be generated, and the thermal fuse may be damaged or broken by the rearc. Even when the thermal fuse may not be damaged or broken, the insulation property after an operation is lowered to produce the probability that, when a high voltage is applied, reconduction occurs to cause a serious problem.

The degrees of the damage or destruction modes of a thermal fuse depend on the level of the destruction energy. The modes are enumerated in the order of degree as follows: ejection of a molten fuse element or a molten flux; destruction of a sealing portion; destruction of an insulating case; and melting of a lead conductor or an insulating case.

When a thermal fuse in which the above-mentioned Bi—Sn alloy is employed as a fuse element is used under a high voltage, an abnormal mode such as damage or destruction at an operation or an insulation failure after an operation easily occurs. The reason of this is estimated as follows. At an operation, a fuse element is changed at once from the solid phase to the liquid phase in which the surface tension is low, without substantially entering an intermediate phase state. When the fuse element is fused off, therefore, the liquefied fuse element is formed into minute particles, and the particles are scattered together with a charred flux due to an arc at the operation. Many of the particles adhere to the inner wall of an outer case, thereby causing the insulation distance after an operation not to be maintained. As a result, such an abnormal mode is caused by the reconduction due to the high-voltage application or generation of a rearc after reinterruption.

The inventor eagerly conducted studies in order to prevent an abnormal mode from occurring when a thermal fuse in which a Bi—Sn alloy is used as a fuse element operates. As a result, it has been found that, when a composition of Bi of larger than 50% and 56% or smaller, and the balance Sn is employed, an abnormal mode can be satisfactorily prevented from occurring and dispersion of the operating temperature can be sufficiently reduced.

The reason why an abnormal mode can be prevented from occurring is estimated as follows. In the specific Bi—Sn alloy composition, a solid-liquid coexisting region (intermediate state) in which the surface tension is relatively large exists with being deviated from a eutectic point and between the solidus temperature and the liquidus temperature. The spheroid division of the fuse element is caused in the intermediate state. As a result, scattering in the form of minute particles hardly occurs. The reason why, contrary to the above-mentioned usual technique, dispersion of the operating temperature of a thermal fuse can be suppressed to a low level even in an alloy composition of a wide solid-liquid coexisting region is estimated as follows. Referring to DSC measurement results shown in FIGS. 8 to 10, the surface tension of a state in the vicinity of the peak p that is the terminal of a process in which a change from the solid phase to the liquid phase rapidly advances reaches a low one necessary for the spheroid division of the fuse element, even before the liquidification process reaches the end (the liquidus temperature).

SUMMARY OF THE INVENTION

It is an object of the invention to, based on the finding, provide an alloy type thermal fuse in which a Bi—Sn alloy is used as a fuse element, which has an operating temperature of about 140° C., which, even when used at a high power, can safely operate, and in which dispersion of the operating temperature can be sufficiently reduced, and also a material for an alloy thermal fuse element.

The material for a thermal fuse element of a first aspect of the invention has an alloy composition in which Bi is larger than 50% and 56% or smaller, and a balance is Sn.

In the material for a thermal fuse element of a second aspect of the invention, 0.1 to 7.0 weight parts, preferably, 0.1 to 3.5 weight parts of one, or two or more elements selected from the group consisting of Ag, Au, Cu, Ni, Pd, Pt, Ga, and Ge are added to 100 weight parts of the alloy composition of the first aspect of the invention.

The materials for a thermal fuse element are allowed to contain inevitable impurities which are produced in productions of metals of raw materials and also in melting and stirring of the raw materials, and which exist in an amount that does not substantially affect the characteristics. In the alloy type thermal fuses, a minute amount of a metal material or a metal film material of the lead conductors or the film electrodes is caused to inevitably migrate into the fuse element by solid phase diffusion, and, when the characteristics are not substantially affected, allowed to exist as inevitable impurities.

In the alloy type thermal fuse of a third aspect of the invention, the material for a thermal fuse element of the first or second aspect of the invention is used as a fuse element.

The alloy type thermal fuse of a fourth aspect of the invention is characterized in that, in the alloy type thermal fuse of the third aspect of the invention, the fuse element contains inevitable impurities.

The alloy type thermal fuse of a fifth aspect of the invention is an alloy type thermal fuse in which, in the alloy type thermal fuse of the third or fourth aspect of the invention, the fuse element is connected between lead conductors, and at least a portion of each of the lead conductors which is bonded to the fuse element is covered with a Sn or Ag film.

The alloy type thermal fuse of a sixth aspect of the invention is an alloy type thermal fuse in which, in the alloy type thermal fuse of any one of the third to fifth aspects of the invention, lead conductors are bonded to ends of the fuse element, respectively, a flux is applied to the fuse element, the flux-applied fuse element is passed through a cylindrical case, gaps between ends of the cylindrical case and the lead conductors are sealingly closed, ends of the lead conductors have a disk-like shape, and ends of the fuse element are bonded to front faces of the disks.

The alloy type thermal fuse of a seventh aspect of the invention is an alloy type thermal fuse in which, in the alloy type thermal fuse of the third or fourth aspect of the invention, a pair of film electrodes are formed on a substrate by printing conductive paste containing metal particles and a binder, the fuse element is connected between the film electrodes, and the metal particles are made of a material selected from the group consisting of Ag, Ag—Pd, Ag—Pt, Au, Ni, and Cu.

The alloy type thermal fuse of an eighth aspect of the invention is an alloy type thermal fuse in which, in the alloy type thermal fuse of any one of the third to seventh aspects of the invention, a heating element for fusing off the fuse element is additionally disposed.

DETAILED DESCRIPTION OF THE PREFERRED EMBODIMENTS

In the invention, a fuse element of a circular wire or a flat wire is used. The outer diameter or the thickness is set to 100 to 800 μm, preferably, 300 to 600 μm.

The reason why, in the first aspect of the invention, the fuse element has an alloy composition of 50%<weight of Bi<56%, and the balance Sn is as follows. In order to eliminate an element harmful to a living body, the first aspect premises the use of a Bi—Sn alloy. As apparent from the DSC measurement results shown in FIGS. 11 and 12, when Bi is 50% or smaller, the solid-liquid coexisting region is excessively wide, and dispersion of the operating temperature is larger than ±3° C. When Bi is larger than 56%, the difference with respect to the eutectic composition (57% Bi, balance Sn) is excessively small, and spheroid division of the thermal fuse element occurs in a substantially complete liquid phase state. Therefore, scattering of minute particles of the alloy together with a charred flux produced by an arc due to an operation easily occurs, and a follow current is readily produced after the arc in the division. As a result, the possibility that an abnormal mode occurs at an operation of a thermal fuse is increased. When the amount of Bi is increased to exceed that (57%) of the eutectic composition and the composition is deviated from the eutectic composition, the specific resistance is increased, and the workability is suddenly impaired.

Figure 8:
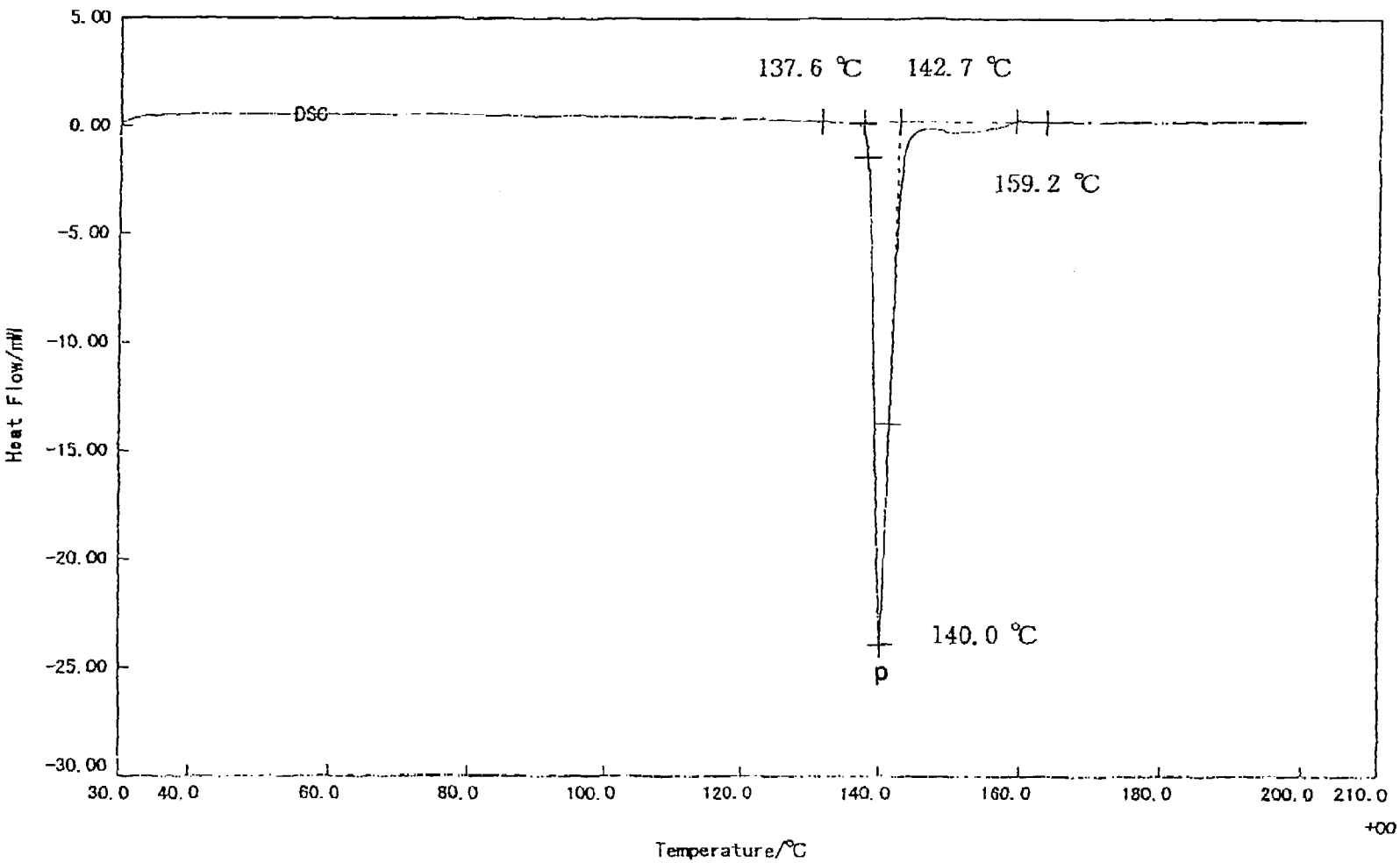
FIG. 8 is a view showing a DSC curve of a fuse element of Example 1.
Figure 9:
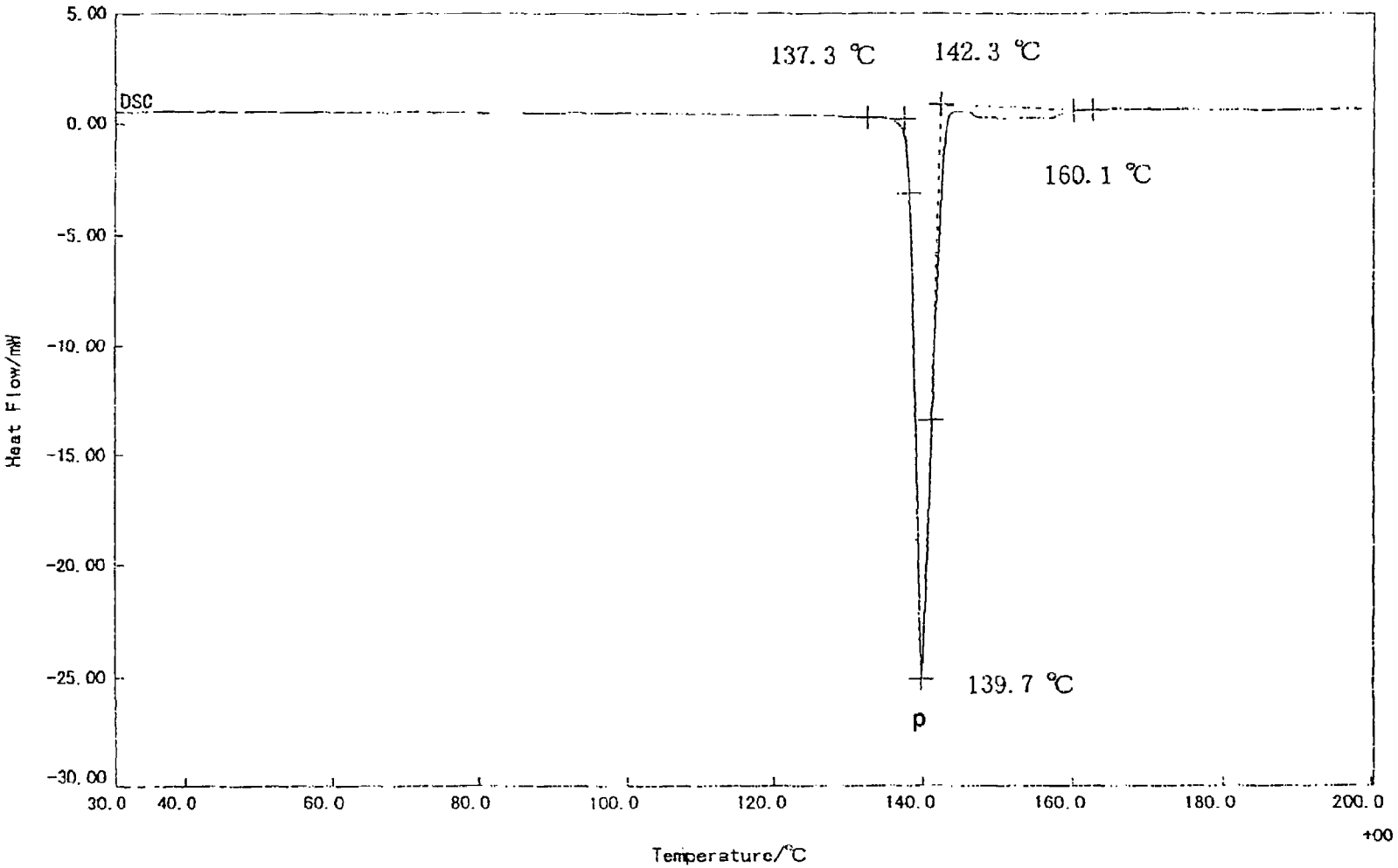
FIG. 9 is a view showing a DSC curve of a fuse element of Example 2.
Figure 10:
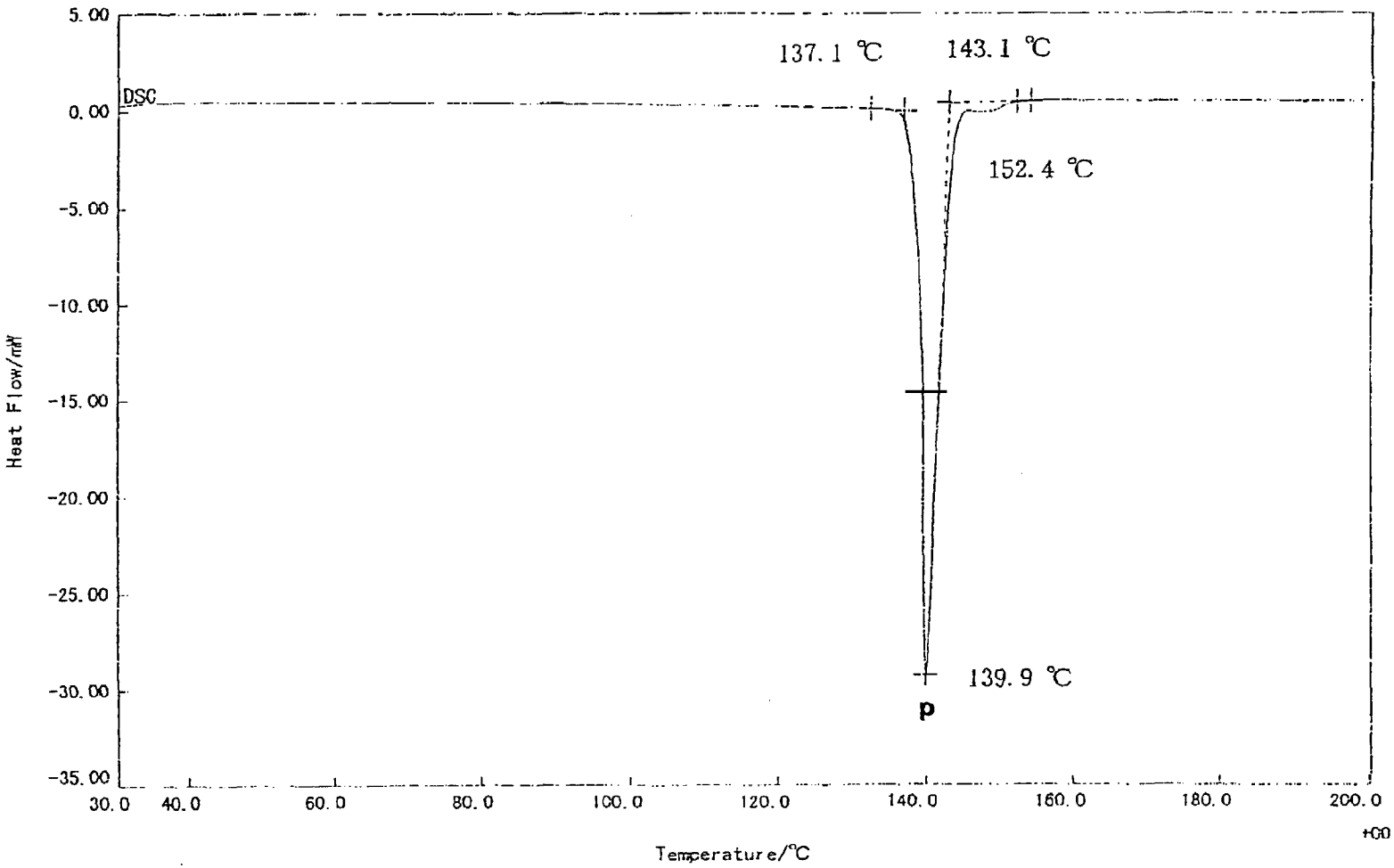
FIG. 10 is a view showing a DSC curve of a fuse element of Example 4.

As apparent from FIGS. 8 to 10 showing results of DSC measurements of a Bi—Sn alloy composition which is useful as a fuse element in the invention, the alloy begins to melt at about 137° C., and reaches an endothermic peak at about 140° C. In this case, a predetermined surface tension S necessary for the spheroid division of the fuse element is attained in the vicinity of the peak p, and a division operation is performed. As a result, the operating temperature is about 140° C. It is estimated that the scattering of minute particles of molten alloy is satisfactorily suppressed by the relatively high viscosity due to the surface tension S.

By contrast, in the eutectic composition, because of the time scale of the spheroid division speed of the fuse element, the spheroid division is performed in a state of a surface tension which is lower than the predetermined surface tension S, without substantially passing through the state of the predetermined surface tension S. It is therefore estimated that the scattering of minute particles of molten alloy easily occurs.

Figure 11:
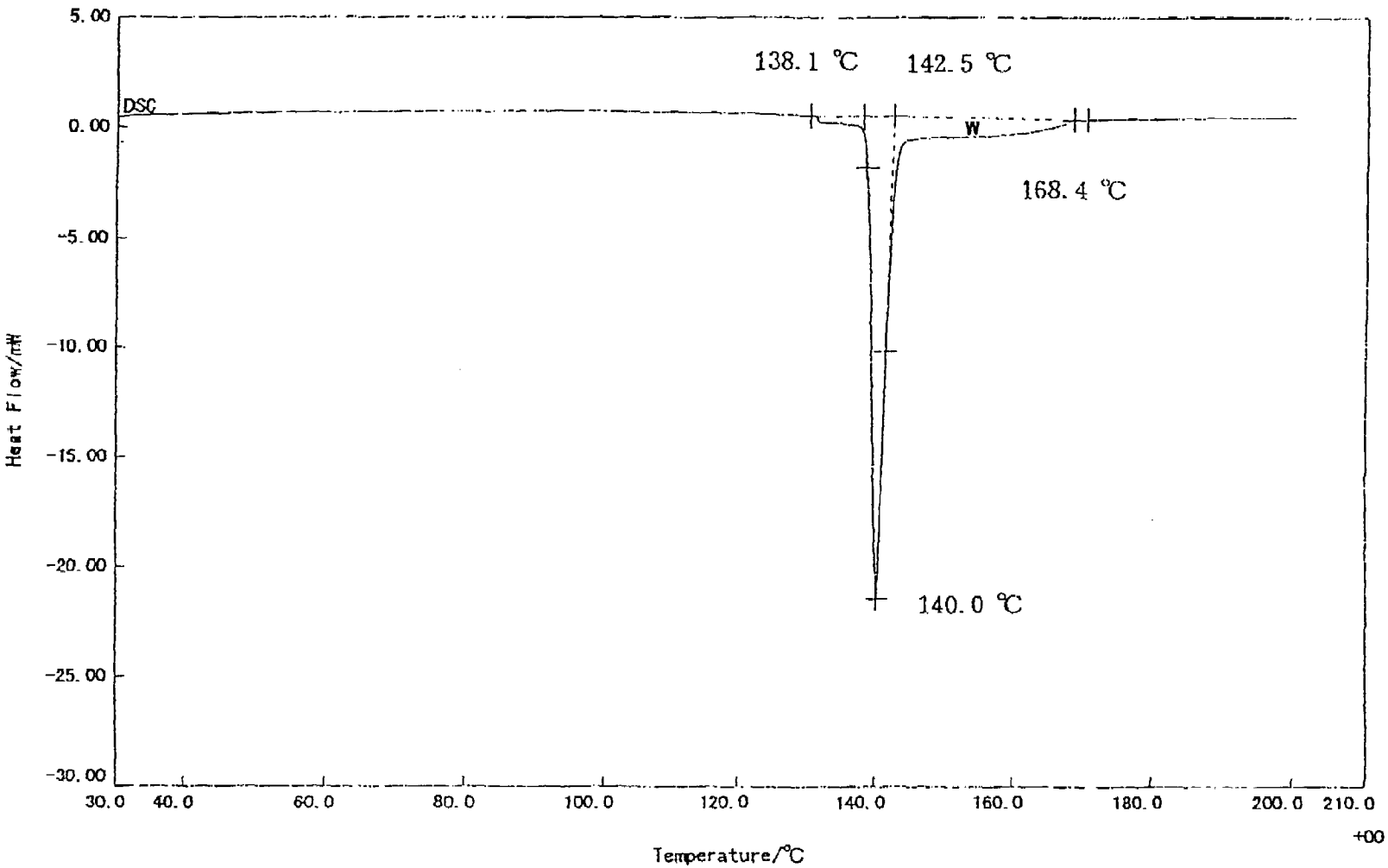
FIG. 11 is a view showing a DSC curve of a fuse element of Comparative Example 2.
Figure 12:
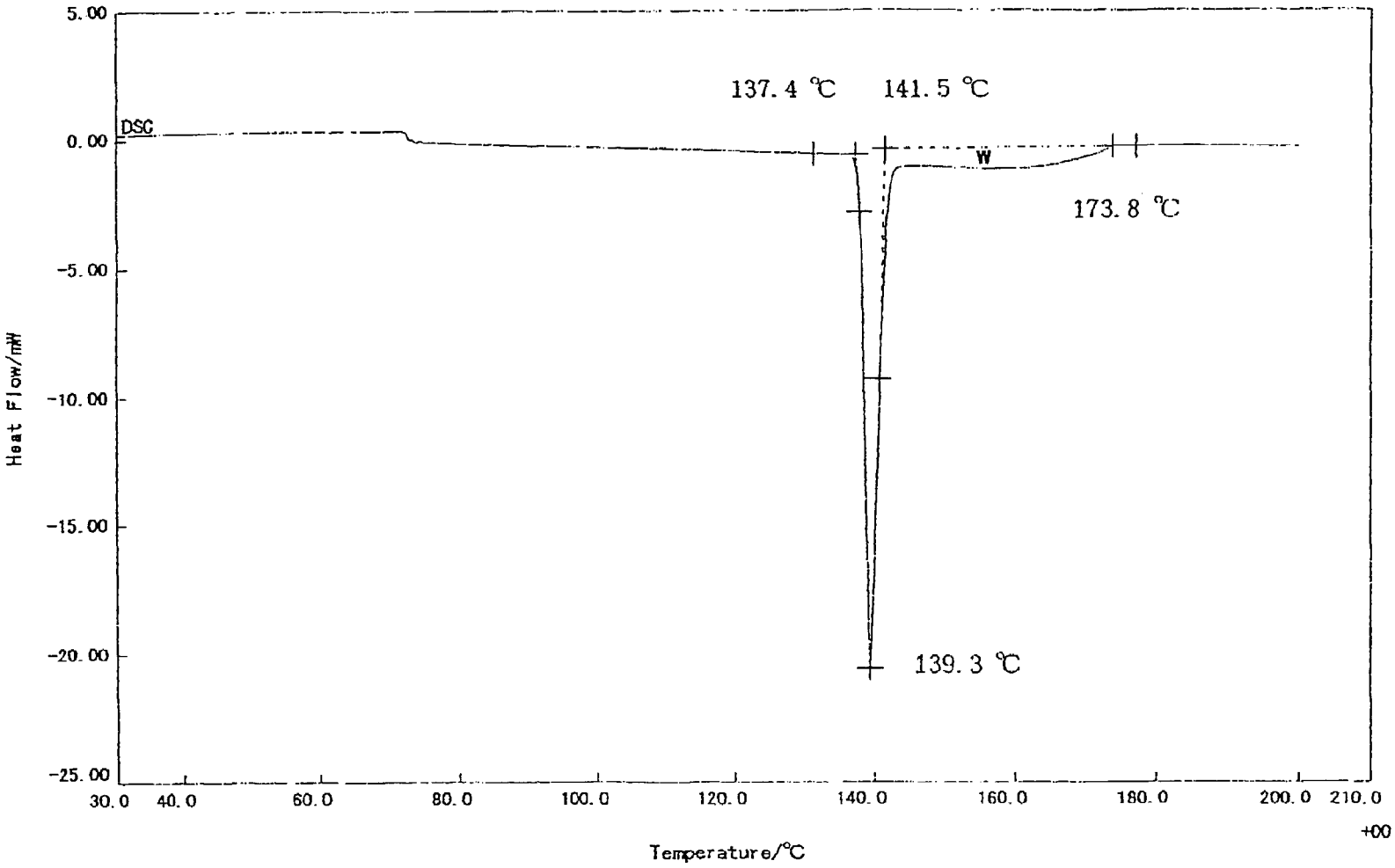
FIG. 12 is a view showing a DSC curve of a fuse element of Comparative Example 3.

In the case where Bi is 50% or smaller, the state of the predetermined surface tension S is attained at a middle of a shoulder w on the liquid phase side in the DSC measurement results of FIGS. 11 and 12. Since the shoulder is wide, the division enabled range extending from the timing when the predetermined surface tension S is attained, to the liquidus temperature is broad. As a result, it is estimated that dispersion of the operating temperature is increased.

In the invention, 0.1 to 7.0 weight parts, preferably, 0.1 to 3.5 weight parts of one, or two or more elements selected from the group consisting of Ag, Au, Cu, Ni, Pd, Pt, Ga, and Ge are added to 100 weight parts of the alloy composition, in order to appropriately widen the solid-liquid coexisting region to improve the overload characteristic and the dielectric breakdown characteristic, and also to reduce the specific resistance of the alloy and improve the mechanical strength. When the addition amount is smaller than 0.1 weight parts, the effects cannot be sufficiently attained, and, when the addition amount is larger than 7.0 weight parts, preferably, 3.5 weight parts, the above-mentioned melting characteristic is hardly maintained.

With respect to a drawing process, further enhanced strength and ductility are provided so that drawing into a thin wire of 100 to 300 μmϕ can be easily conducted. Furthermore, the fuse element can be made tackless, so that superficial bonding due to the cohesive force of the fuse element can be eliminated. Therefore, the accuracy of the acceptance criterion in a test after weld bonding of the fuse element can be improved.

It is known that a to-be-bonded material such as a metal material of the lead conductors, a thin-film material, or a particulate metal material in the film electrode migrates into the fuse element by solid phase diffusion. When the same element as the to-be-bonded material, such as Ag, Au, Cu, or Ni is previously added to the fuse element, the migration can be suppressed. Therefore, an influence of the to-be-bonded material which may originally affect the characteristics (for example, Ag, Au, or the like causes local reduction or dispersion of the operating temperature due to the lowered melting point, and Cu, Ni, or the like causes dispersion of the operating temperature or an operation failure due to an increased intermetallic compound layer formed in the interface between different phases) is eliminated, and the thermal fuse can be assured to normally operate, without impairing the function of the fuse element.

The fuse element of the alloy type thermal fuse of the invention can be usually produced by a method in which a billet is produced, the billet is extrusively shaped into a stock wire by an extruder, and the stock wire is drawn by a dice to a wire. The outer diameter is 100 to 800 μmϕ, preferably, 300 to 600 μmϕ. The wire can be finally passed through calender rolls so as to be used as a flat wire.

Alternatively, the fuse element may be produced by the rotary drum spinning method in which a cylinder containing cooling liquid is rotated, the cooling liquid is held in a layer-like manner by a rotational centrifugal force, and a molten material jet ejected from a nozzle is introduced into the cooling liquid layer to be cooled and solidified, thereby obtaining a thin wire member.

In the production, the alloy composition is allowed to contain inevitable impurities which are produced in productions of metals of raw materials and also in melting and stirring of the raw materials.

The invention may be implemented in the form of a thermal fuse serving as an independent thermoprotector. Alternatively, the invention may be implemented in the form in which a thermal fuse element is connected in series to a semiconductor device, a capacitor, or a resistor, a flux is applied to the element, the flux-applied fuse element is placed in the vicinity of the semiconductor device, the capacitor, or the resistor, and the fuse element is sealed together with the semiconductor device, the capacitor, or the resistor by means of resin mold, a case, or the like.

Figure 1:
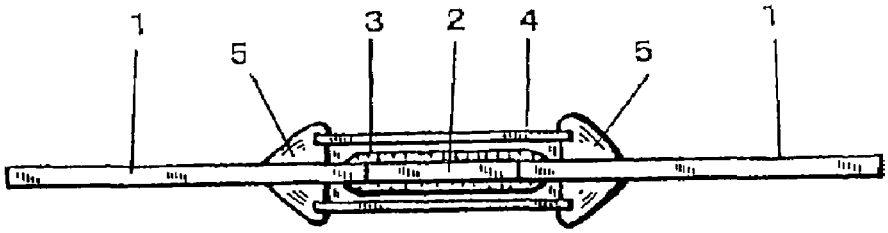
FIG. 1 is a view showing an example of the alloy type thermal fuse of the invention.

FIG. 1 shows an alloy type thermal fuse of the cylindrical case type according to the invention. A fuse element 2 of the first or second aspect of the invention is connected between a pair of lead conductors 1 by, for example, welding. A flux 3 is applied to the fuse element 2. The flux-applied fuse element is passed through an insulating tube 4 which is excellent in heat resistance and thermal conductivity, for example, a ceramic tube. Gaps between the ends of the insulating tube 4 and the lead conductors 1 are sealingly closed by a sealing agent 5 such as a cold-setting epoxy resin.

Figure 2:
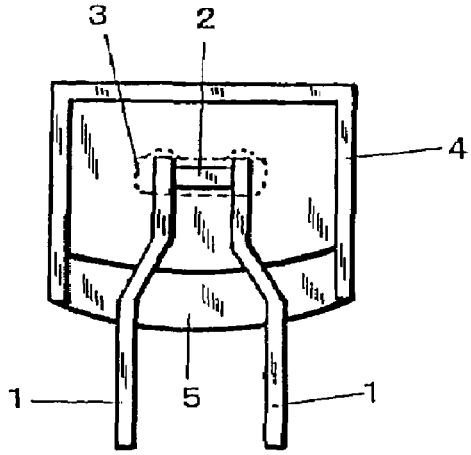
FIG. 2 is a view showing another example of the alloy type thermal fuse of the invention.

FIG. 2 shows a fuse of the radial case type. A fuse element 2 of claim 1 or 2 of the invention is connected between tip ends of parallel lead conductors 1 by, for example, welding. A flux 3 is applied to the fuse element 2. The flux-applied fuse element is enclosed by an insulating case 4 in which one end is opened, for example, a ceramic case. The opening of the insulating case 4 is sealingly closed by sealing agent 5 such as a cold-setting epoxy resin.

Figure 3:
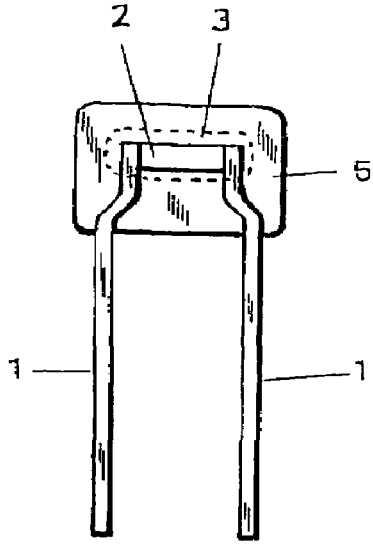
FIG. 3 is a view showing a further example of the alloy type thermal fuse of the invention.

FIG. 3 shows a fuse of the radial resin dipping type. A fuse element 2 of claim 1 or 2 of the invention is bonded between tip ends of parallel lead conductors 1 by, for example, welding. A flux 3 is applied to the fuse element 2. The flux-applied fuse element is dipped into a resin solution to seal the element by an insulative sealing agent such as an epoxy resin 5.

Figure 4:
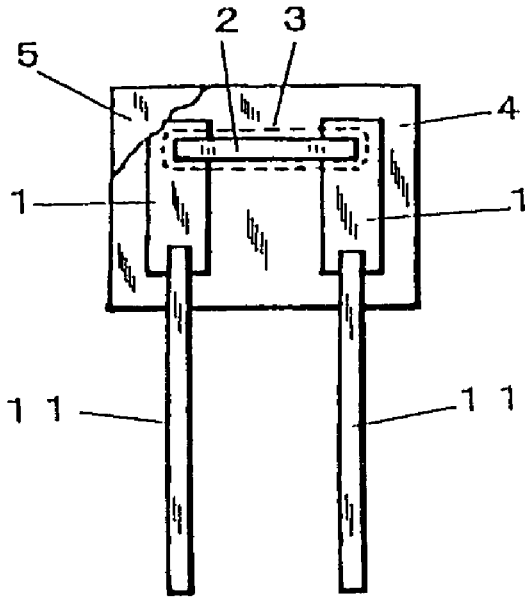
FIG. 4 is a view showing a still further example of the alloy type thermal fuse of the invention.

FIG. 4 shows a fuse of the substrate type. A pair of film electrodes 1 are formed on an insulating substrate 4 such as a ceramic substrate by printing conductive paste. Lead conductors 11 are connected respectively to the electrodes 1 by, for example, welding or soldering. A fuse element 2 of claim 1 or 2 of the invention is bonded between the electrodes 1 by, for example, welding. A flux 3 is applied to the fuse element 2. The flux-applied fuse element is covered with a sealing agent 5 such as an epoxy resin. The conductive paste contains metal particles and a binder. For example, Ag, Ag—Pd, Ag—Pt, Au, Ni, or Cu may be used as the metal particles, and a material containing a glass frit, a thermosetting resin, and the like may be used as the binder.

In the alloy type thermal fuses, in the case where Joule's heat of the fuse element is negligible, the temperature Tx of the fuse element when the temperature of the appliance to be protected reaches the allowable temperature Tm is lower than Tm by 2 to 3° C., and the melting point of the fuse element is usually set to [Tm−(2 to 3° C.)].

Figure 5:
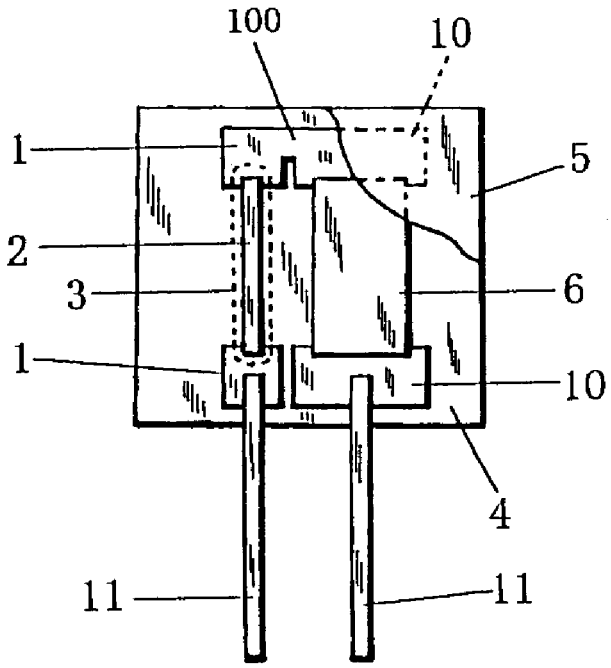
FIG. 5 is a view showing a still further example of the alloy type thermal fuse of the invention.

The invention may be implemented in the form in which a heating element for fusing off the fuse element is additionally disposed on the alloy type thermal fuse. As shown in FIG. 5, for example, a conductor pattern 100 having fuse element electrodes 1 and resistor electrodes 10 is formed on the insulating substrate 4 such as a ceramic substrate by printing conductive paste, and a film resistor 6 is disposed between the resistor electrodes 10 by applying and baking resistance paste (e.g., paste of metal oxide powder such as ruthenium oxide). A fuse element 2 of claim 1 or 2 of the invention is bonded between the fuse element electrodes 1 by, for example, welding. A flux 3 is applied to the fuse element 2. The flux-applied fuse element 2 and the film resistor 6 are covered with a sealing agent 5 such as an epoxy resin.

In the fuse having an electric heating element, a precursor causing abnormal heat generation of an appliance is detected, the film resistor is energized to generate heat in response to a signal indicative of the detection, and the fuse element is fused off by the heat generation.

The heating element may be disposed on the upper face of an insulating substrate. A heat-resistant and thermal-conductive insulating film such as a glass baked film is formed on the heating element. A pair of electrodes are disposed, flat lead conductors are connected respectively to the electrodes, and the fuse element is connected between the electrodes. A flux covers a range over the fuse element and the tip ends of the lead conductors. An insulating cover is placed on the insulating substrate, and the periphery of the insulating cover is sealingly bonded to the insulating substrate by an adhesive agent.

Among the alloy type thermal fuses, those of the type in which the fuse element is directly bonded to the lead conductors (FIGS. 1 to 3) may be configured in the following manner. At least portions of the lead conductors where the fuse element is bonded are covered with a thin film of Sn or Ag (having a thickness of, for example, 15 μm or smaller, preferably, 5 to 10 μm) (by plating or the like), thereby enhancing the bonding strength with respect to the fuse element.

In the alloy type thermal fuses, there is a possibility that a metal material or a thin film material in the lead conductors, or a particulate metal material in the film electrode migrates into the fuse element by solid phase diffusion. As described above, however, the characteristics of the fuse element can be sufficiently maintained by previously adding the same element as the thin film material into the fuse element.

As the flux, a flux having a melting point which is lower than that of the fuse element is generally used. For example, useful is a flux containing 90 to 60 weight parts of rosin, 10 to 40 weight parts of stearic acid, and 0 to 3 weight parts of an activating agent. In this case, as the rosin, a natural rosin, a modified rosin (for example, a hydrogenated rosin, an inhomogeneous rosin, or a polymerized rosin), or a purified rosin thereof can be used. As the activating agent, hydrochloride or hydrobromide of an amine such as diethylamine, or an organic acid such as adipic acid can be used.

Figure 6:
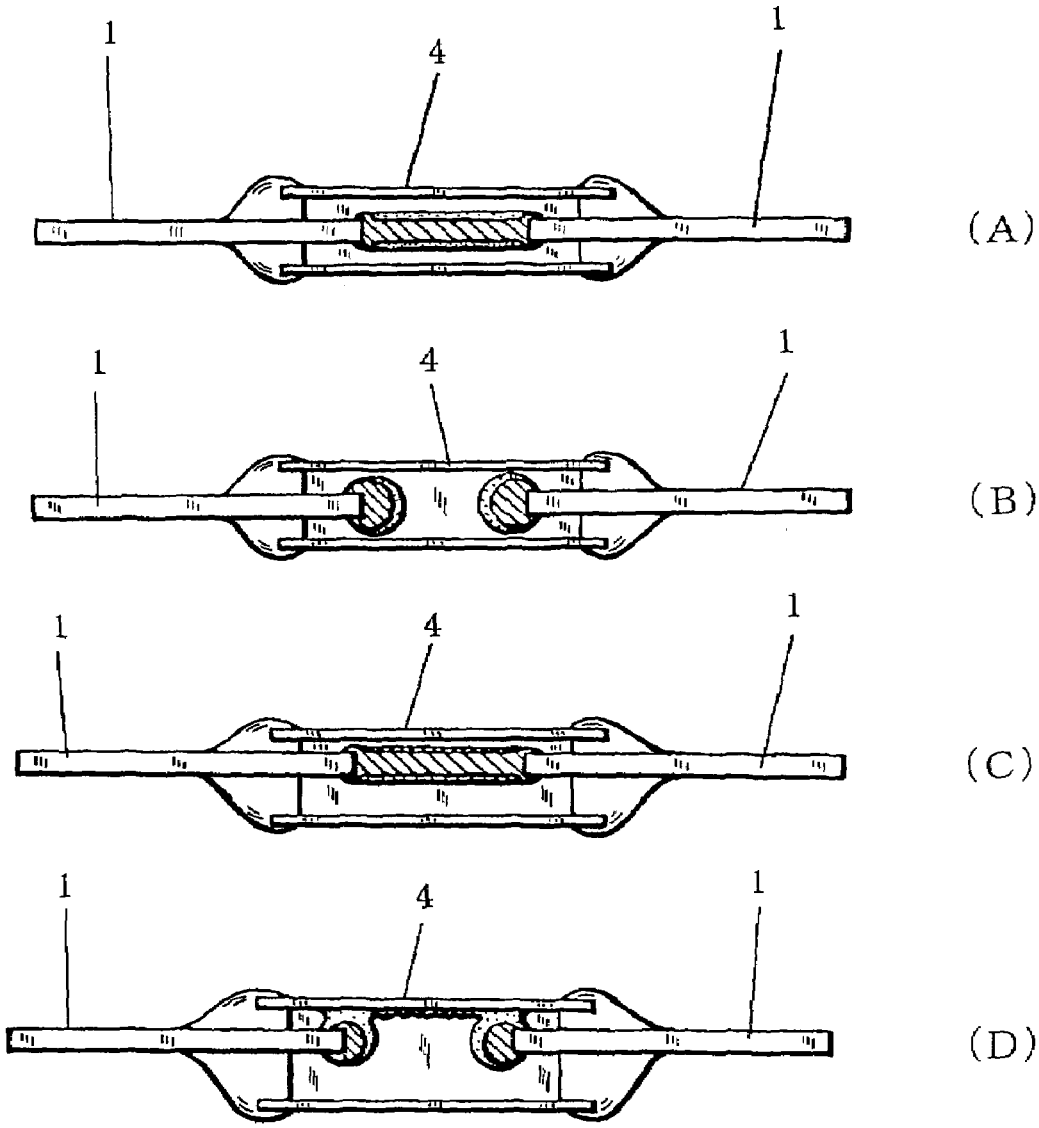
FIG. 6 is a view showing an alloy type thermal fuse of the cylindrical case type and its operation state.

Among the above-described alloy type thermal fuses, in the fuse of the cylindrical case type, the arrangement in which the lead conductors 1 are placed so as not to be eccentric to the cylindrical case 4 as shown in (A) of FIG. 6 is a precondition to enable the normal spheroid division shown in (B) of FIG. 6. When the lead conductors are eccentric as shown in (C) of FIG. 6, the flux (including a charred flux) and scattered alloy portions easily adhere to the inner wall of the cylindrical case after an operation as shown in (D) of FIG. 6. As a result, the insulation resistance is lowered, and the dielectric breakdown characteristic is impaired.

Figure 7:
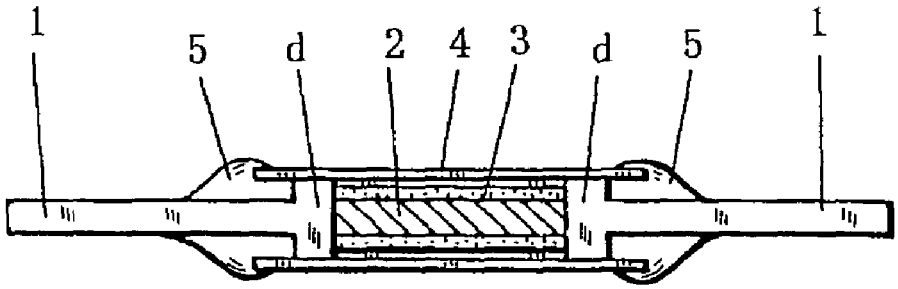
FIG. 7 is a view showing a still further example of the alloy type thermal fuse of the invention.
Figure 7:
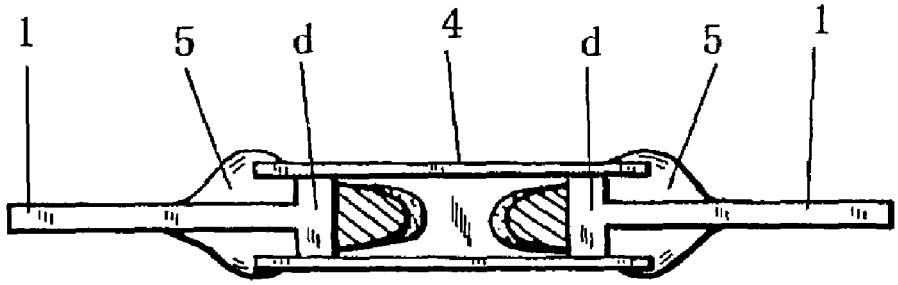

In order to prevent such disadvantages from being produced, as shown in (A) of FIG. 7, a configuration is effective in which ends of the lead conductors 1 are formed into a disk-like shape d, and ends of the fuse element 2 are bonded to the front faces of the disks d, respectively (by, for example, welding). The outer peripheries of the disks are supported by the inner face of the cylindrical case, and the fuse element 2 is positioned so as to be substantially concentrical with the cylindrical case 4 [in (A) of FIG. 7, 3 denotes a flux applied to the fuse element 2, 4 denotes the cylindrical case, 5 denotes a sealing agent such as an epoxy resin, and the outer diameter of each disk is approximately equal to the inner diameter of the cylindrical case]. In this instance, as shown in (B) of FIG. 7, molten portions of the fuse element spherically aggregate on the front faces of the disks d, thereby preventing the flux (including a charred flux) and the scattered alloy from adhering to the inner face of the case 4.

EXAMPLES

In the following examples and comparative examples, alloy type thermal fuses of the cylindrical case type having an AC rating of 5 A×250 V were used. The fuses have the following dimensions. The outer diameter of a cylindrical ceramic case is 3.3 mm, the thickness of the case is 0.5 mm, the length of the case is 11.5 mm, a lead conductor is a Sn plated annealed copper wire of an outer diameter of 1.0 mmϕ, and the outer diameter and length of a fuse element are 1.0 mmϕ and 4.0 mm, respectively. A compound of 80 weight parts of natural rosin, 20 weight parts of stearic acid, and 1 weight part of hydrobromide of diethyl-amine was used as the flux. A cold-setting epoxy resin was used as a sealing agent.

The solidus and liquidus temperatures of a fuse element were measured by a DSC at a temperature rise rate of 5° C./min.

Fifty specimens were used. Each of the specimens was immersed into an oil bath in which the temperature was raised at a rate of 1° C./min., while supplying a detection current of 0.1 A to the specimen, and the temperature T0 of the oil when the current supply was interrupted by blowing-out of the fuse element was measured. A temperature of T0−2° C. was determined as the operating temperature of the thermal fuse element.

An abnormal mode at an operation of the thermal fuse was evaluated on the basis of the overload test method and the dielectric breakdown test method defined in IEC 60691(the humidity test before the overload test was omitted).

Specifically, existence of destruction or physical damage at an operation was checked. While a voltage of 1.1× the rated voltage and a current of 1.5× the rated current were applied to a specimen, and the thermal fuse was caused to operate by raising the environmental temperature at a rate of (2±1) K/min. Among specimens in which destruction or damage did not occur, those in which the insulation between lead conductors withstood 2× the rated voltage (500 V) for 1 min., and that between the lead conductors and a metal foil wrapped around the fuse body after an operation withstood 2× the rated voltage+1,000 V (1,500 V) for 1 min. were judged acceptable with respect to the dielectric breakdown characteristic, and those in which the insulation resistance between the lead conductors when a DC voltage of 2× the rated voltage (500 V) was applied was 0.2 MΩ or higher, and that between the lead conductors and the metal foil wrapped around the fuse body after an operation was 2 MΩ or higher were judged acceptable with respect to the insulation resistance. Acceptance with respect to both the dielectric breakdown characteristic and the insulation characteristic was set as the acceptance criterion for the insulation stability. When 50 specimens were used and all of the 50 specimens were accepted with respect to the insulation stability, the specimens were evaluated as ○, and, when even one of the specimens was not accepted, the specimens were evaluated as x.

Example 1

A composition of 53% Bi and the balance Sn was used as that of a fuse element. A fuse element was produced by a process of drawing to 300 μmϕ under the conditions of an area reduction per dice of 6.5%, and a drawing speed of 50 m/min. As a result, excellent workability was attained while no breakage occurred and no constricted portion was formed.

FIG. 8 shows a result of the DSC measurement. The solidus temperature was 138° C., the liquidus temperature was 159° C., and the maximum endothermic peak temperature was 140.0° C.

The fuse element temperature at an operation of a thermal fuse was 141±1° C. Therefore, it is apparent that the fuse element temperature at an operation of a thermal fuse approximately coincides with the maximum endothermic peak temperature of 140.0° C.

Even when the overload test was conducted, the fuse element was able to operate without involving any physical damage such as destruction. With respect to the dielectric breakdown test after the operation, the insulation between lead conductors withstood 2× the rated voltage (500 V) for 1 min. or longer, and that between the lead conductors and a metal foil wrapped around the fuse body after the operation withstood 2× the rated voltage+1,000 V (1,500 V) for 1 min. or longer. Therefore, the fuse element was acceptable. With respect to the insulation characteristic, the insulation resistance between the lead conductors when a DC voltage of 2× the rated voltage (500 V) was applied was 0.2 MΩ or higher, and that between the lead conductors and the metal foil wrapped around the fuse body after an operation was 2 MΩ or higher. Both the resistances were acceptable, and hence the insulation stability was evaluated as ○.

The reason why the overload characteristic and the insulation stability after an operation are excellent as described above is as follows. Even during the energization and temperature rise, the division of the fuse element is performed in the solid-liquid coexisting region. Therefore, scattering of minute particles of the molten alloy is suppressed, and an arc is not generated at an operation, so that extreme temperature rise hardly occurs. Consequently, pressure rise by vaporization of the flux and charring of the flux due to the temperature rise can be suppressed, and physical destruction does not occur, whereby a sufficient insulation distance can be ensured after division.

Examples 2 to 4

The examples were conducted in the same manner as Example 1 except that the alloy composition in Example 1 was changed as listed in Table 1.

FIG. 9 shows a result of a DSC measurement of Example 2, and FIG. 10 shows a result of a DSC measurement of Example 4.

The solidus and liquidus temperatures of the examples are shown in Table 1. The fuse element temperatures at an operation are as shown in Table 1, have dispersion of ±2° C. or smaller, and are in the solid-liquid coexisting region.

In the same manner as Example 1, both the overload characteristic and the insulation stability are acceptable. The reason of this is estimated as follows. In the same manner as Example 1, the fuse element is divided in a solid-liquid coexisting region.

In all the examples, good wire drawability was obtained in the same manner as Example 1.

TABLE 1

| | Ex. 2 | Ex. 3 | Ex. 4 |
|---|---|---|---|
| Bi (%) | 51 | 54 | 56 |
| Sn (%) | Balance | Balance | Balance |
| Solidus temperature (° C.) | 137.3 | 137.2 | 137.1 |
| Liquidus temperature (° C.) | 160.1 | 157.6 | 152.4 |
| Wire drawability | Good | Good | Good |
| Element temperature at operation (° C.) | 142 ± 2 | 141 ± 1 | 140 ± 1 |
| Overload characterisitic | Damage, etc. are not observed | Damage, etc. are not observed | Damage, etc. are not observed |
| Insulation stability | ○ | ○ | ○ |

Example 5

The example was conducted in the same manner as Example 1 except that an alloy composition in which 1 weight part of Ag was added to 100 weight parts of the alloy composition of Example 1 was used as that of a fuse element.

A wire member for a fuse element of 300 μmϕ was produced under conditions in which the area reduction per dice was 8% and the drawing speed was 80 m/min., and which are severer than those of the drawing process of a wire member for a fuse element in Example 1. However, no wire breakage occurred, and problems such as a constricted portion were not caused, with the result that the example exhibited excellent workability.

The solidus temperature, the maximum endothermic peak temperature, and the fuse element temperature at an operation of a thermal fuse are approximately identical with those of Example 1. It was confirmed that the operating temperature and the melting characteristic of Example 1 can be substantially held.

In the same manner as Example 1, even when the overload test was conducted, the fuse element was able to operate without involving any physical damage such as destruction. Therefore, the fuse element was acceptable. With respect to the dielectric breakdown test after the operation, the insulation between lead conductors withstood 2× the rated voltage (500 V) for 1 min. or longer, and that between the lead conductors and a metal foil wrapped around the fuse body after the operation withstood 2× the rated voltage+1,000 V (1,500 V) for 1 min. or longer. Therefore, the fuse element was acceptable. With respect to the insulation characteristic, the insulation resistance between the lead conductors when a DC voltage of 2× the rated voltage (500 V) was applied was 0.2 MΩ or higher, and that between the lead conductors and the metal foil wrapped around the fuse body after an operation was 2 MΩ or higher. Both the resistances were acceptable, and hence the insulation stability was evaluated as ○. Therefore, it was confirmed that, in spite of addition of Ag, the good overload characteristic and insulation stability can be held.

It was confirmed that the above-mentioned effects are obtained in the range of the addition amount of 0.1 to 7.0 weight parts of Ag.

In the case where the metal material of the lead conductors to be bonded, a thin film material, or a particulate metal material in the film electrode is Ag, it was confirmed that, when the same element or Ag is previously added as in the example, the metal material can be prevented from, after a fuse element is bonded, migrating into the fuse element with time by solid phase diffusion, and local reduction or dispersion of the operating temperature due to the lowered melting point can be eliminated.

Examples 6 to 12

The examples were conducted in the same manner as Example 1 except that an alloy composition in which 0.5 weight parts of respective one of Au, Cu, Ni, Pd, Pt, Ga, and Ge were added to 100 weight parts of the alloy composition of Example 1 was used as that of a fuse element.

It was confirmed that, in the same manner as the metal addition of Ag in Example 5, also the addition of Au, Cu, Ni, Pd, Pt, Ga, or Ge realizes excellent workability, the operating temperature and melting characteristic of Example 1 can be sufficiently ensured, the good overload characteristic and insulation stability can be held, and solid phase diffusion between metal materials of the same kind can be suppressed.

It was confirmed that the above-mentioned effects are obtained in the range of the addition amount of 0.1 to 7.0 weight parts of respective one of Au, Cu, Ni, Pd, Pt, Ga, and Ge.

Comparative Example 1

The comparative example was conducted in the same manner as Example 1 except that the composition of the fuse element in Example 1 was changed to 57% Bi and the balance Sn (eutectic).

The workability was satisfactory. Since the solid-liquid coexisting region is substantially zero, dispersion of the operating temperature at an operation was very small or 140±1° C. In the overload test and the dielectric breakdown test, however, breakage or an insulation failure frequently occurred, with the result that the fuse can be hardly used under the AC rating of 250 V and 5 A. The reason of this is estimated as follows. At an operation, a fuse element is changed at once from the solid phase to the liquid phase in which the surface tension is low, without substantially entering an intermediate phase state. When the fuse element is fused off, therefore, the liquefied fuse element is formed into minute particles, and the particles are scattered together with a charred flux due to an arc at the operation. Many of the particles adhere to the inner wall of an outer case, thereby causing the insulation distance after an operation not to be maintained. As a result, the insulation distance after an operation cannot be held, and the reconduction due to the high-voltage application or generation of a rearc after reinterruption occurs.

Comparative Example 2

The comparative example was conducted in the same manner as Example 1 except that the composition of the fuse element in Example 1 was changed to 49% Bi and the balance Sn.

The workability was satisfactory. FIG. 11 shows a result of a DSC measurement. As compared with the result of a DSC measurement of Example 2 shown in FIG. 9, the shoulder w on the liquid phase side is considerably large. The fuse element temperature at an operation extended over 139 to 147° C. As described above, it is estimated that the excessive dispersion is caused by the large shoulder width of the solid-liquid coexisting region on the liquid phase side.

Comparative Example 3

The comparative example was conducted in the same manner as Example 1 except that the composition of the fuse element in Example 1 was changed to 47% Bi and the balance Sn.

The workability was satisfactory. The fuse element temperature at an operation extended over 139 to 158° C., and dispersion of the temperature was excessively large. FIG. 12 shows a result of a DSC measurement. The shoulder w on the liquid phase side is large. As described above, it is estimated that the excessive dispersion of the operating temperature is caused by the large shoulder width of the solid-liquid coexisting region on the liquid phase side.

EFFECTS OF THE INVENTION

According to the material for a thermal fuse element and the thermal fuse of the invention, it is possible to provide an alloy type thermal fuse in which a Bi—Sn alloy not containing a metal harmful to the ecological system is used, and which is excellent in overload characteristic, dielectric breakdown characteristic after an operation, and insulation characteristic. Therefore, the invention is useful for a high power rated thermal fuse.

According to the material for a thermal fuse element and the alloy type thermal fuse of claim 2 of the invention, since a fuse element can be easily thinned because of the excellent wire drawability of the material for a thermal fuse element, the thermal fuse can be advantageously miniaturized and thinned. Even in the case where an alloy type thermal fuse is configured by bonding a fuse element to a to-be-bonded material which may originally exert an influence, a normal operation can be assured while maintaining the performance of the fuse element.

According to the alloy type thermal fuses of claims 3 to 8 of the invention, particularly, the above effects can be assured in a thermal fuse of the cylindrical case type, a thermal fuse of the substrate type, a thermal fuse having an electric heating element, and a thermal fuse or a thermal fuse having an electric heating element in which lead conductors are plated by Ag or the like, whereby a high power rating can be attained in such a thermal fuse and a thermal fuse having an electric heating element.

What is claimed is:

1. An alloy type thermal fuse containing a thermal fuse element comprising an alloy composition in which Bi is larger than 50% and 56% or smaller, and a balance is Sn, wherein said fuse element is connected between lead conductors, and at least a portion of each of said lead conductors which is bonded to said fuse element is covered with a Sn or Ag film.

2. The alloy type thermal fuse according to claim 1, wherein said fuse element contains inevitable impurities.

3. The alloy type thermal fuse according to claim 2, wherein lead conductors are bonded to ends of said fuse element, respectively, a flux is applied to said fuse element, said flux-applied fuse element is passed through a cylindrical case, gaps between ends of said cylindrical case and said lead conductors are sealingly closed, ends of said lead conductors have a disk-like shape, and ends of said fuse element are bonded to front faces of said disks.

4. The alloy type thermal fuse according to claim 3, wherein a heating element for fusing off said fuse element is additionally disposed.

5. The alloy type thermal fuse according to claim 2, wherein a heating element for fusing off said fuse element is additionally disposed.

6. The alloy type thermal fuse according to claim 1, wherein lead conductors are bonded to ends of said fuse element, respectively, a flux is applied to said fuse element, said flux-applied fuse element is passed through a cylindrical case, gaps between ends of said cylindrical case and said lead conductors are sealingly closed, ends of said lead conductors have a disk-like shape, and ends of said fuse element are bonded to front faces of said disks.

7. The alloy type thermal fuse according to claim 6, wherein a heating element for fusing off said fuse element is additionally disposed.

8. The alloy type thermal fuse according to claim 1, wherein a heating element for fusing off said fuse element is additionally disposed.

9. An alloy type thermal fuse containing a thermal fuse element comprising an alloy composition in which Bi is larger than 50% and 56% or smaller, and a balance is Sn, wherein lead conductors are bonded to ends of said fuse element, respectively, a flux is applied to said fuse element, said flux-applied fuse element is passed through a cylindrical case, gaps between ends of said cylindrical case and said lead conductors are sealingly closed, ends of said lead conductors have a disk-like shape, and ends of said fuse element are bonded to front faces of said disks.

10. The alloy type thermal fuse according to claim 9, wherein said fuse element contains inevitable impurities.

11. The alloy type thermal fuse according to claim 10, wherein a heating element for fusing off said fuse element is additionally disposed.

12. The alloy type thermal fuse according to claim 9, wherein a heating element for fusing off said fuse element is additionally disposed.

13. An alloy type thermal fuse containing a thermal fuse element comprising an alloy composition in which Bi is larger than 50% and 56% or smaller, and a balance is Sn, wherein a pair of film electrodes are formed on a substrate by printing conductive paste containing metal particles and a binder, said fuse element is connected between said film electrodes, and said metal particles are made of a material selected from the group consisting of Ag, Ag—Pd, Ag—Pt, Au, Ni, and Cu.

14. The alloy type thermal fuse according to claim 13, wherein said fuse element contains inevitable impurities.

15. The alloy type thermal fuse according to claim 14, wherein a heating element for fusing off said fuse element is additionally disposed.

16. The alloy type thermal fuse according to claim 13, wherein a heating element for fusing off said fuse element is additionally disposed.

* * * * *